US005344058A

United States Patent [19]

Baffo

[11] Patent Number: 5,344,058

[45] Date of Patent: Sep. 6, 1994

[54] METHOD AND APPARATUS FOR PRECISELY DRIVING FILM MATERIAL

[75] Inventor: Mario Baffo, Woburn, Mass.

[73] Assignee: ECRM Trust, Tewksbury, Mass.

[21] Appl. No.: 84,772

[22] Filed: Jun. 29, 1993

Related U.S. Application Data

[63] Continuation of Ser. No. 902,507, Jun. 23, 1992, abandoned, which is a continuation of Ser. No. 664,819, Mar. 5, 1991, abandoned.

[51] Int. Cl.[5] ..... B65H 20/02; B30B 3/00

[52] U.S. Cl. ..... 226/181; 100/176; 226/186

[58] Field of Search ..... 226/181, 182, 183, 186, 226/187, 190, 191, 194; 400/641; 271/273, 274; 100/176

[56] References Cited

U.S. PATENT DOCUMENTS

| | | | |
|---|---|---|---|
| 1,006,990 | 10/1911 | Warren | 29/132 |
| 2,280,208 | 4/1942 | Wilkie | 29/132 X |
| 2,786,672 | 3/1957 | Humphries | 226/186 |
| 2,789,209 | 4/1957 | Montijo, Jr. | 226/186 |
| 3,402,656 | 9/1968 | Stocking | 100/176 X |
| 3,613,977 | 10/1971 | Egan | 226/91 |
| 3,856,461 | 12/1974 | Jordan | 100/176 X |
| 4,100,945 | 7/1978 | Reach et al. | 226/187 X |
| 4,200,389 | 4/1980 | Matsui et al. | 100/176 X |
| 4,368,837 | 1/1983 | Bodewein | 226/186 X |
| 4,383,631 | 5/1983 | Fairchild | 226/186 |
| 4,527,174 | 7/1985 | Fujiwara et al. | 226/181 X |

OTHER PUBLICATIONS

IBM Technical Disclosure Bulletin, "Paper Feed Roller and Transport," Bullock et al; vol. 22, No. 6; Nov. 1979.

*Primary Examiner*—Daniel P. Stodola
*Attorney, Agent, or Firm*—Hale and Dorr

[57] ABSTRACT

A method and apparatus for precisely advancing film material between two rollers includes a driven roller having a medium hardness rubber surface and a non-driven hard surfaced roller which contacts precision surfaces at either end of the driven roller to accurately control the spacing between the two rollers. The non-driven roller is urged against the driven roller precision surfaces by a spring force, and causes the rubber of the driven roller to compress when film material is in an operative position between the roller pair.

9 Claims, 3 Drawing Sheets

METHOD AND APPARATUS FOR PRECISELY DRIVING FILM MATERIAL

This application is a continuation of now-abandoned Ser. No. 07/902,507, filed Jun. 23, 1992, which itself is a continuation of now-abandoned Ser. No. 07/664,819 filed Mar. 5, 1991.

BACKGROUND OF THE INVENTION

The invention relates generally to a method and apparatus for driving thin materials, and in particular to a method and apparatus for precisely controlling the movement of film materials between a pair of rollers in an electronic imaging system.

In a high resolution system where film material is advanced for exposure to a laser beam one line at a time, it is important to precisely control the advancement of the film. When advancing the film between two rollers, if the film is misaligned by even 1/8000 of an inch, the recorded image may display unwanted artifacts and be flawed. Therefore, it is important to ensure that the film is driven uniformly along its entire length.

Various combinations of driven and pinch rollers have been used for driving film materials. The construction of such rollers can include covering one or both rollers with a rubber layer to grab the film. When the rubber covering is very soft, it advantageously grasps the film; however, the rubber can pull or stretch, causing the film to move unevenly, especially in the driven direction. When a hard rubber is used, the rubber may not grip the film firmly enough and slippage may occur. Other roller combinations pair a soft rubber-coated driven roller with a hard rubber-coated non-driven roller; but in such a compromise the film tends to curl around the soft rubber roller rather than properly exiting from between the roller pair. Pairing a metallic surfaced non-driven roller with a hard rubber-coated driven roller proved more successful; but friction between the rollers and the film was often insufficient, and some slippage can occur. Furthermore, in any of the above combinations, minute differences in the outside radius from one end of a roller to the other can cause the film to skew when driven.

Other prior solutions to the problem attempt to align the rollers by applying equal or separate pressure to the non-driven roller in order to control the radius of the driven roller. This solution has met with some success but results in a mechanically elaborate and expensive system.

A primary object of the invention therefore is to construct a roller system wherein one roller is urged against another roller in a manner which precisely controls the location of the film, produces a precise drive control, eliminates skew, and is mechanically simple to build.

SUMMARY OF THE INVENTION

The invention relates to an apparatus and method for passing film material between two rollers wherein a non-driven roller is urged against a driven roller in a manner that causes one roller to compress in a precise and controlled manner as the material passes between the rollers.

In a preferred embodiment of the invention, the driven roller is the width of the film or sheet to be driven through the roller pair, while the non-driven roller is longer than the width of the material being driven. The driven roller has a metal core and an outer surface made of a medium hardness rubber (between 45–70 durometers). Bearings, having precision surfaces, are attached at either end of the shaft of the driven roller. The non-driven roller is made of a hard material, preferably metal, and extends beyond the width of the film on both ends to contact the precision alignment bearing surfaces and thus create a precise alignment surface relative to the driven roller.

At each end of the non-driven roller shaft is a spring which connects to the non-driven roller and urges the non-driven roller against the driven roller bearing surface. Pressure from the spring ensures that the non-driven roller stays in contact with the driven roller bearing surface, and when film is inserted between the two rollers, the rubber of the driven roller is caused to compress under the spring force.

In the illustrated embodiment, the rubber covering of the driven roller is approximately 1/8 inch thick, but the thickness can vary as long as the rubber is thick enough to be compressed when the film passes between the rollers in their operative driving position. The effective radius of the driven roller will be determined, mainly, by the diameter of the bearing surfaces (which is constant and very precise) and by the thickness of the film material inserted between the two rollers (the thickness variations are minute). In this way, any fluctuation in the diameter of the uncompressed driven roller rubber surface will automatically be compensated for by the compression of the rubber by the film.

In another embodiment of the invention, precision wheels, attached to or a part of, or integral with the driven roller shaft, can be used in place of bearings. The wheels would be coaxial with the driven roller shaft and engage the bottom roller in the same manner as the bearings described above. Other alignment mechanisms can be attached to the shaft of the driven roller or be otherwise incorporated in the driven roller, for the same purpose.

For loading film between the rollers, the non-driven roller of the invention is attached at its ends to respective pivoting arms, each of which is attached to a spring that urges the non-driven roller against the precision alignment surfaces of the driven roller. One arm is engaged by a cam-lever mechanism which pivots the non-driven roller away from the driven roller to allow insertion of the film therebetween.

BRIEF DESCRIPTION OF THE DRAWINGS

Other objects, features, and advantages of the invention will be apparent from the following description of the invention together with the drawings in which.

DESCRIPTION OF A PREFERRED EMBODIMENT

Figure 1:
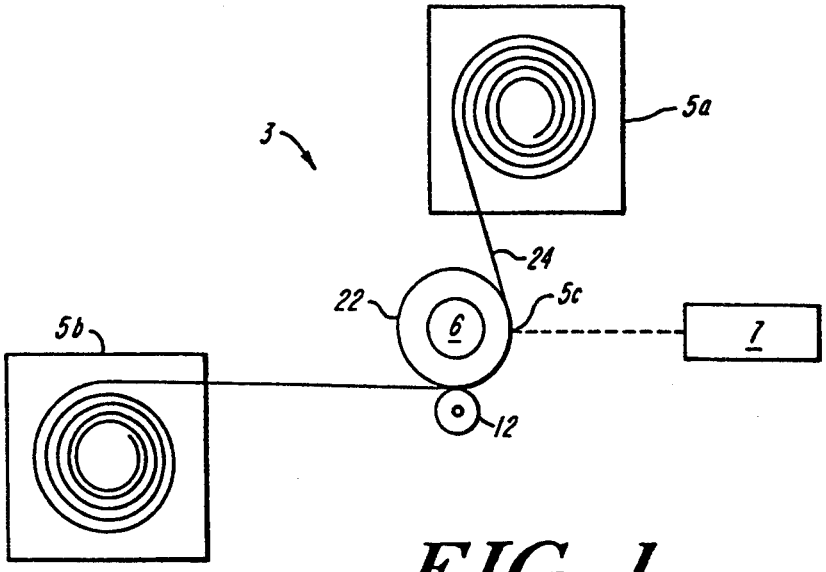
FIG. 1 is a schematic representation of a typical application of the invention.

Referring to FIG. 1, in a typical application of the invention, a film recording system 3 has a supply cassette 5*a* and a take-up cassette 5*b* for a film material 24. The film material 24 passes around a driven roller 6 which has a rubber coating 22 to grab and drive the film material 24. The driven roller 6 drives the film primarily at a nip formed between the roller and a non-driven roller 12. The film is exposed, for example by a laser scanning mechanism 7 along an image line 5*c* as the film passes the line 5*c* (which is traced by the laser scanning system).

Figure 2:
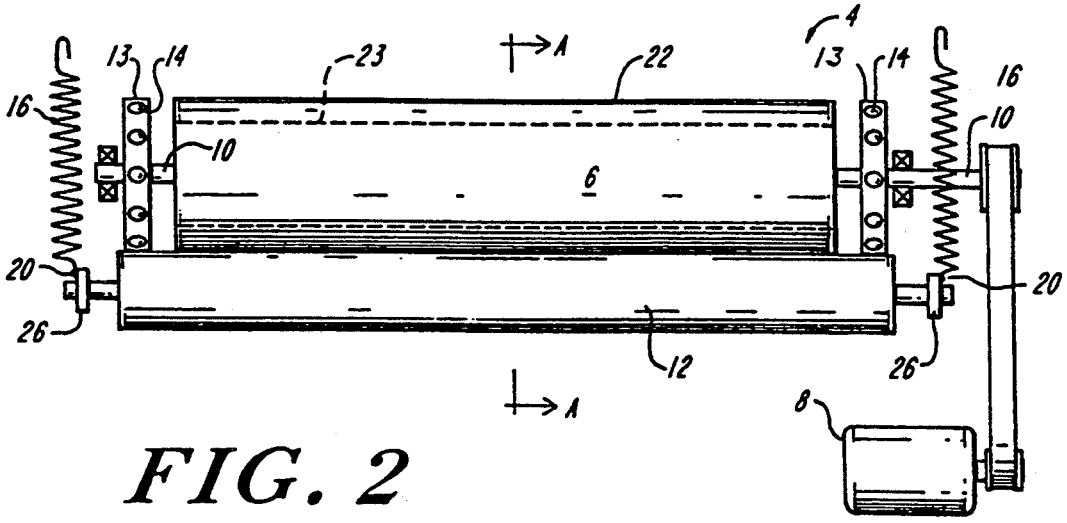
FIG. 2 is a front elevation view showing the roller assembly of a preferred embodiment of the invention.

Referring to FIG. 2, a roller system 4 advances a film material between a driven roller 6, driven by a motor 8 which engages its shaft 10, and a non-driven roller 12 which is urged into contact with precision alignment surfaces 13 of bearings 14 constrained at each end of the driven roller shaft 10. Non-driven roller 12 is a precision machined metallic cylinder which is urged against the bearing surfaces 13 of roller bearings 14 by springs 16 attached to a pivoting arm 26 (shown in FIG. 6) at spring posts 20.

The driven roller 6 has a medium hardness rubber coating 22 of between 45–70 durometers, approximately 1/8 inch thick, covering a metallic cylindrical core 23.

Figure 3:
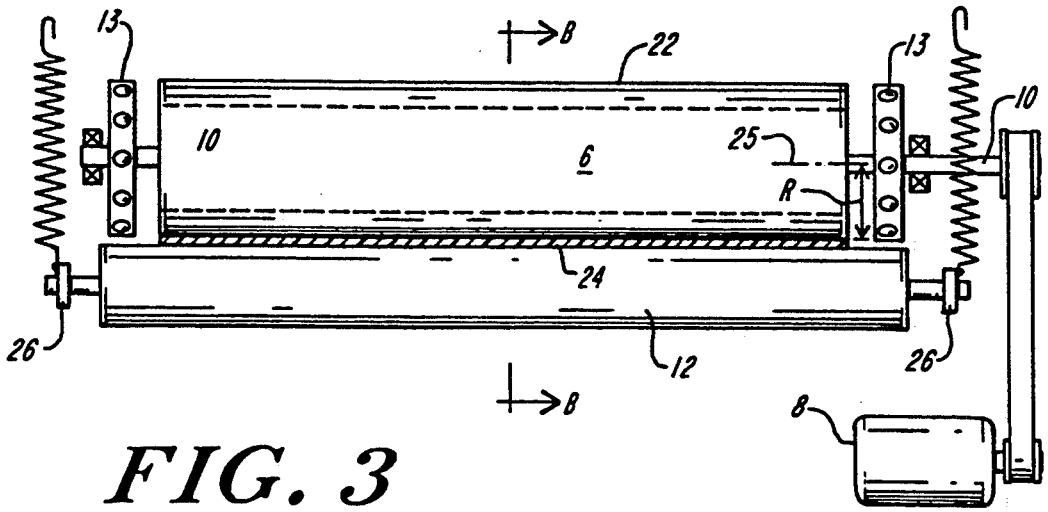
FIG. 3 is a front elevation view showing the roller assembly of the preferred embodiment of the invention with film material therebetween.

Referring to FIG. 3, as the motor 8 rotates the shaft 10 of driven roller 6, a film material 24, inserted between the two rollers, is grabbed by the rubber coating 22 of driven roller 6 and causes the non-driven roller 12 to rotate in a direction opposite that of the driven roller. Rollers 6 and 12 are so spaced from each other that the film material, as it moves between the rollers, causes the coating 22 to compress. As roller 6 is driven, the film advances between the rollers.

Figure 4:
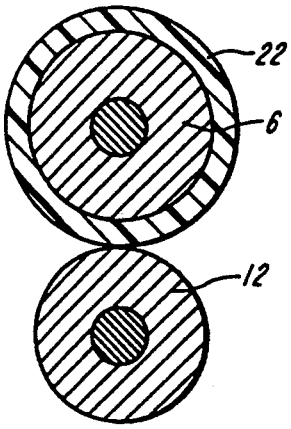
FIG. 4 is a cross-sectional view along lines AA of FIG. 2.

Thus, referring to FIG. 4, which is cross-sectional view taken along line AA in FIG. 2, the two rollers 6 and 12 are urged against each other so that the hard surface of roller 12 rests against the precision surfaces 13 of bearings 14. Thus, the interaction of the surfaces 13 and the hard, non-driven roller 12 control the spacing between the non-driven roller and the rubber surface of the driven roller 6. Since the surface of driven roller 6 may have small imperfections because it is composed of a rubber surface coating, the actual spacing between the two rollers may vary at their closest points of contact. Preferably, however, according to the preferred embodiment of the invention, the two rollers are just touching when in this film-free operative position.

Figure 5:
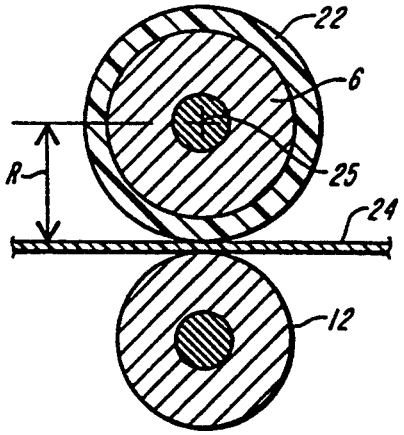
FIG. 5 is a cross-sectional view along lines BB of FIG. 3.

Referring to FIG. 5, when the film material 24 is inserted between the rollers, and the non-driven roller 12 is thereafter urged toward and abuts the precision surfaces 13, the film material is pushed or urged into the softer rubber coating 22 of roller 6, compresses that rubber coating, and accordingly is grabbed by it in a driving relationship as the driven roller 6 rotates. Importantly, since the thickness of the film material is a closely controlled value, and since the spacing between the axis of the driven roller 6 and the precision surface of the non-driven roller 12 is tightly controlled by the tolerances placed on the non-driven roller and the precision with which the precision alignment surfaces 13 can be obtained, the effective driving radius R (between the shaft axis 25 and the film) of the driving roller 6 is tightly controlled across its entire length, thereby precisely and accurately driving the film material through the nip between the rollers. The compression of the rubber coating 22 is illustrated in the cross-sectional view along line B—B taken in FIG. 3 and illustrated in FIG. 5.

Figure 6:
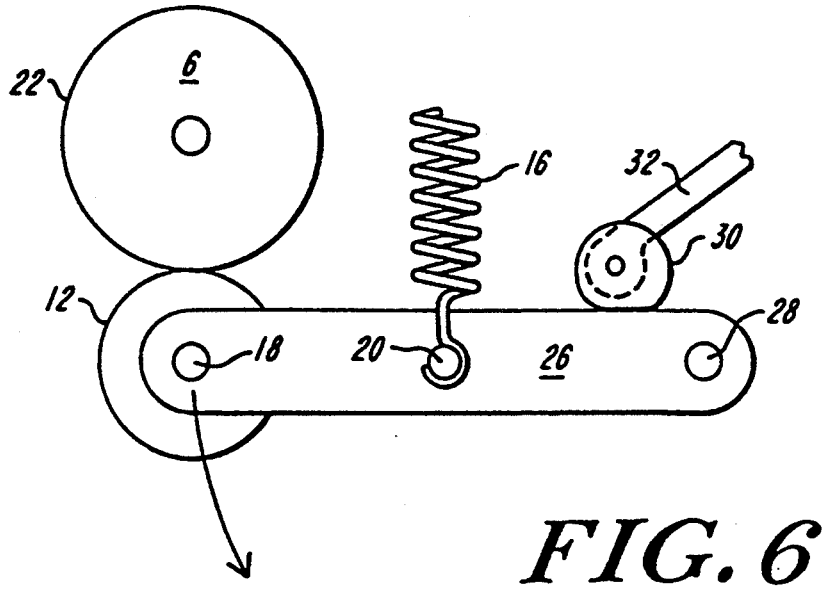
FIG. 6 is a side elevation view showing the roller assembly with the pivoting arm mechanism.

Referring to FIG. 6, the mechanism for separating the rollers 6 and 12 for loading the film material is shown. Non-driven roller 12 is attached at either end of its shaft 18 to a pivoting arm 26. Each arm 26 pivots around pivot pins 28. A cam 30, rotated by a lever 32, has an interfering relationship with arm 26 as the cam rotates (as lever 32 rotates); and the pivoting arm 26, in response, moves or pivots roller 12 away from driven roller 6 for loading or inserting film between the rollers. As the pivoting arms 26 are moved downward (in the illustrated embodiment), springs 16 extend. After the film material is inserted between the rollers, the cam 30 is rotated to allow pivoting arm 26 to swing upward into a closed, operative position, where roller 12 is urged against bearing surface 15, with the rubber coating 22 of driven roller 6 being compressed by the action of roller 12 bearing against the film material.

Figure 7:
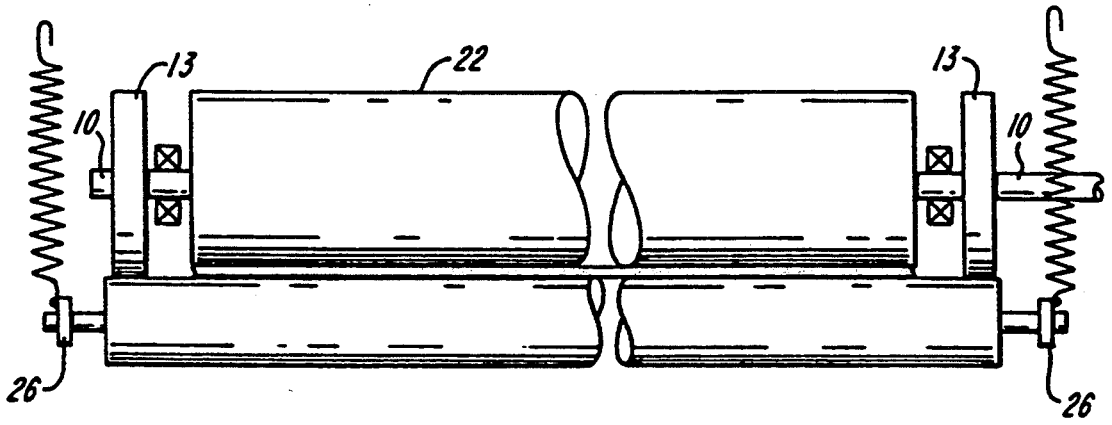
FIG. 7 is a front elevation view the roller assembly according to another particular embodiment of the invention.

It should be apparent to those of ordinary skilled in the art that other methods for precisely controlling the spacing between the driven and non-driven rollers can be employed. Thus, referring to FIG. 7, the precision surfaces 13 can be integral with the rubber coated roller surface 22 and can be integrally attached to and be part of the shaft 10. An alternative construction could provide for a single driven roller of constant nominal diameter wherein the ends of the roller contain the hard precision alignment surfaces while the interior of the roller has relatively softer rubber surface. It is also important to note that the rubber surface should not be either too hard or too soft since to make it too hard prevents the compression needed to properly grab and move the film through the nip between the rollers, while to make it too soft can cause, as noted above, an undesirable flexibility and uncontrollable movement of the rubber, much like a spongy material, even under compression. Finally, other materials having the desired coefficients of friction and hardness could be substituted for the materials described in the illustrated embodiment.

Additions, subtractions, deletions, and other modifications of the claimed invention will be apparent to those practiced in the art and are within the scope of the following claims.

What is claimed is:

1. Apparatus for driving a film between two rollers comprising:

a driven roller including a core having an outer cylindrical surface, an axially-extending portion of said surface being covered with a resilient coating that extends axially of said core such that said coating will contact said film being driven by said apparatus across the film's entire width;

a non-driven roller having an outer cylindrical surface harder than that of the resilient coating on said driven roller;

a pair of cylindrical precision alignment surfaces, one of said pair of alignment surfaces being provided adjacent each end of the resilient coating of the driven roller, and each of said precision alignment surfaces being coaxial with the axis of one of said rollers and being arranged to contact a respective portion of the outer cylindrical surface of the other of said rollers; and means for causing said contact between each of said precision alignment surfaces and a said respective portion, the distance between the axis of said driven roller and the axis of said non-driven roller being determined by said contact, and said means and said distance being such that said precision alignment surfaces remain in contact with said respective portions when said film is interposed between said rollers and said resilient coating compresses where said coating on said driven roller surface contacts said film.

2. The apparatus of claim 1 wherein said precision surface is the surface of precision ball bearings secured to the ends of said driven roller.

3. The apparatus of claim 1 wherein said precision surfaces are integral with the driven roller.

4. The apparatus of claim 1 further wherein said contacting means comprises a first and second pivoting arm connected to either end of one of said rollers, and springs connected to said pivoting arms for urging contact between said non-driven roller and said precision surfaces such that insertion of film between the rollers increases the pressure of the non-driven roller against the driven roller.

5. The apparatus of claim 4 further comprising a cam mechanism for pivoting said non-driven roller away from the driven roller for purposes of film insertion.

6. The apparatus of claim 1 wherein said precision alignment surfaces are coaxial with said driven roller and engage respective portions of the outer cylindrical surface of said non-driven roller.

7. Apparatus for driving a film between two rollers comprising:

a driven roller having a cylindrical rigid core an axially extending portion of which is covered with a resilient coating having a hardness between 45–70 durometers, said coating extending in an axial direction over the surface of the core such that said coating will contact said film being driven so that the coating contacts the full width of the film;

a pair of roller bearings, each of said bearings having a cylindrical hard surfaced bearing surface and said bearings being mounted at opposite ends of the driven roller and coaxial therewith;

a non-driven roller having a precision cylindrical surface harder than that of the resilient coating of the driven roller, portions of said precision surface of said non-driven roller extending axially beyond the axially-spaced ends of the coating of the driven roller for contact with said cylindrical bearing surfaces of said roller bearings;

springs connected for urging said portions of said cylindrical surface of said non-driven roller and said cylindrical bearing surfaces into contact with each other such that said contact determines the distance between the axis of said driven roller and the axis of said non-driven roller;

first and second pivoting arms connected to respective ends of said non-driven roller; and means for pivoting the non-driven roller relative to said driven roller between a first position in which said non-driven roller is spaced away from said driven roller for allowing film to be inserted therebetween, and a second position in which said bearing surfaces contact said portions of said cylindrical surface of said non-driven roller, said springs, said resilient coating and said distance between said axes being such that said coating compresses and said precision surfaces and said portions remain in contact when said film is introduced between said rollers.

8. Apparatus for driving a film between two rollers comprising:

a driven roller having an outer cylindrical surface a portion of which is covered by an axially extending resilient coating;

a non-driven roller substantially parallel to said driven roller and having an outer cylindrical surface;

a pair of axially spaced cylindrical precision alignment surfaces, each of said alignment surfaces being mounted adjacent a respective axial end of said resilient coating coaxial with said driven roller; and, means for causing contact between said precision alignment surfaces and axially-spaced portions of said outer surface of said non-driven roller, the distance between the axis of said driven roller and the axis of said non-driven roller being determined by said contact between said precision alignment surfaces and said portions of said outer surface of said non-driven roller, and said distance and said means being such that said precision alignment surfaces remain in contact with said portions of said outer surface of said non-driven roller when said film is interposed between said rollers and said resilient coating compresses where said coating on said driven roller contacts said film.

9. A method of constructing a roller system for driving a thin film between two rollers, comprising:

providing a driven roller having an outer cylindrical surface, a major portion of the axial length of said outer cylindrical surface of said driven roller being covered with a resilient coating;

providing a non-driven roller having an axially-extending outer cylindrical surface;

providing a pair of spaced-apart cylindrical precision alignment surfaces, each of said precision alignment surfaces being coaxial with said driven roller, being positioned adjacent a respective axial-end of said resilient coating coaxial, and having a diameter not less than that of said coating;

accurately mounting said rollers relative to each other such that the axes of said rollers are substantially parallel, and such that each of precision alignment surfaces is in positive contact with a respective portion of the outer cylindrical surface of said non-driven roller, said resilient coating and said mounting being such that said coating compresses and said alignment surfaces remain in contact with said outer cylindrical surface of said non-driven roller when said film is introduced between said rollers; and, driving said driven roller only and in a controlled and precision manner.

* * * * *